US011266562B1

(12) United States Patent
Wehmeyer

(10) Patent No.: US 11,266,562 B1
(45) Date of Patent: Mar. 8, 2022

(54) TACTILE TILES AND INSTALLATION METHODS

(71) Applicant: Donald Wehmeyer, Bellevue, WA (US)

(72) Inventor: Donald Wehmeyer, Bellevue, WA (US)

( * ) Notice: Subject to any disclaimer, the term of this patent is extended or adjusted under 35 U.S.C. 154(b) by 0 days.

(21) Appl. No.: 17/485,091

(22) Filed: Sep. 24, 2021

(51) Int. Cl.
*A61H 3/06* (2006.01)
*E01C 15/00* (2006.01)

(52) U.S. Cl.
CPC ..... *A61H 3/066* (2013.01); *E01C 15/00* (2013.01); *A61H 2201/169* (2013.01); *E01C 2201/16* (2013.01)

(58) Field of Classification Search
CPC .. A61H 3/006; A61H 2201/169; A61H 3/066; E01C 15/00; E01C 2201/16
USPC ..... 404/34–36, 72–75
See application file for complete search history.

(56) References Cited

U.S. PATENT DOCUMENTS 6,718,714 B1 4/2004 Montgomery, Sr.
6,890,124 B2 * 5/2005 Provenzano, III ..... A61H 3/066 249/2
7,303,800 B2 * 12/2007 Rogers ..... F16B 21/02 428/44
7,674,066 B2 3/2010 Wehmeyer
7,690,862 B2 * 4/2010 Szekely ..... E01F 1/00 404/19
7,740,413 B1 * 6/2010 Grayson ..... A61H 3/066 404/73
8,528,278 B2 9/2013 Sippola
9,814,649 B1 * 11/2017 Meyers ..... A61H 3/066
9,895,284 B2 * 2/2018 Henshue ..... A61H 3/066
10,497,228 B2 * 12/2019 Novick ..... E01C 11/04
10,927,554 B1 2/2021 Kimble
2008/0008526 A1 * 1/2008 Boghossian ..... E01C 5/00 404/71
2008/0280097 A1 * 11/2008 Flaherty ..... E01C 5/20 428/131
2010/0229783 A1 * 9/2010 Szekely ..... E01C 5/00 116/202
2015/0173995 A1 6/2015 Bub

* cited by examiner

*Primary Examiner* — Raymond W Addie
(74) *Attorney, Agent, or Firm* — Perkins Coie LLP; Kenneth H. Ohriner

(57) ABSTRACT

A tactile tile assembly includes a base having a plate section, a rim projecting up from the plate section, and a plurality of embedment anchors on the base. A tactile tile is adapted to fit into or onto the base. Fasteners extending through the tactile tile attach it to the base. The top of the rim may be substantially co-planar with a top surface projections on the tactile tile. The embedment anchors may be provided in a plane of the plate section and be bent to a position perpendicular to the plate section for embedment into a pavement material. The base has attachment elements for attaching the tile assembly to an adjoining tile assembly. Two or more tile assemblies are attached together to provide a tile assembly combination of a desired size and shape. The tile assembly combination is then installed in the paving material.

20 Claims, 9 Drawing Sheets

TACTILE TILES AND INSTALLATION METHODS

FIELD OF THE INVENTION

The present invention relates to tactile tiles which aid the visually impaired, and methods for installing tactile tiles.

BACKGROUND OF THE INVENTION

Products and methods for producing detectable warnings for the visually impaired on various surfaces, such as tactile tiles, are widely used. Various tactile tile designs also allow for relatively simple replacement, if damaged. For example, my U.S. Pat. No. 7,674,066, incorporated herein by reference, discloses a tactile tile with detachable anchors which allow for quick and simple replacement of a damaged tile. Although these and other tactile tiles have performed well in the past, engineering challenges remain. Existing tactile tiles generally are provided in fixed incremental widths and lengths. As a result, multiple sizes of tactile tiles must be manufactured and supplied so that the desired tile size is available for a specific installation site. Existing tactile tiles tend to be subject to damage, especially from snow plows. Thus, there is a need for improved tactile tiles and related methods.

SUMMARY OF THE INVENTION

In a one aspect, a tile assembly includes a base having a plate section, a rim projecting up from the plate section, and a plurality of embedment anchors on the base. A tactile tile is adapted to fit into or onto the base. The tactile tile has a plurality of projections on a top of tile. Fasteners extending through the tactile tile attach it to the base. The top of the rim may be substantially co-planar with a top surface of the projections. The embedment anchors may be provided in a plane of the plate section and be bent to a position perpendicular to the plate section for embedment into a pavement material.

In another aspect, the base has attachment elements for attaching the tile assembly to an adjoining tile assembly. The attachment elements may include at least one attachment tab on each side of the rim and at least attachment slot in each side of the rim.

In another aspect, before installation into a paving material two or more tile assemblies are attached together to provide a tile assembly combination of a desired size and shape. The tile assembly combination is then installed in the paving material.

These and other aspects and advantages of the present invention will become better understood with reference to the following Detailed Discussion with accompanying drawings, examples and claims.

BRIEF DESCRIPTION OF THE DRAWINGS

In the drawings, the same number indicates the same element in each of the views.

DETAILED DESCRIPTION

The present tactile tile assemblies and methods are primarily designed for use as detectable warning surfaces for pedestrians, wheelchair users, and other individuals, and for alerting visually impaired individuals to potential hazards, such as curb drop-offs, street crossings, boarders of pools, boating areas and marinas, railroad crossings, drop-offs from raised platforms and the like. The tactile tile assemblies and methods are also preferably designed to comply with American with Disabilities Act ("ADA") rules and regulations, and those of state and local municipalities, dealing with accessibility on walkways in public rights of way and with respect to surfaces of walkways and other public (and private) pedestrian-used walking surfaces that enable tactile detection by visually impaired persons.

Figure 1:
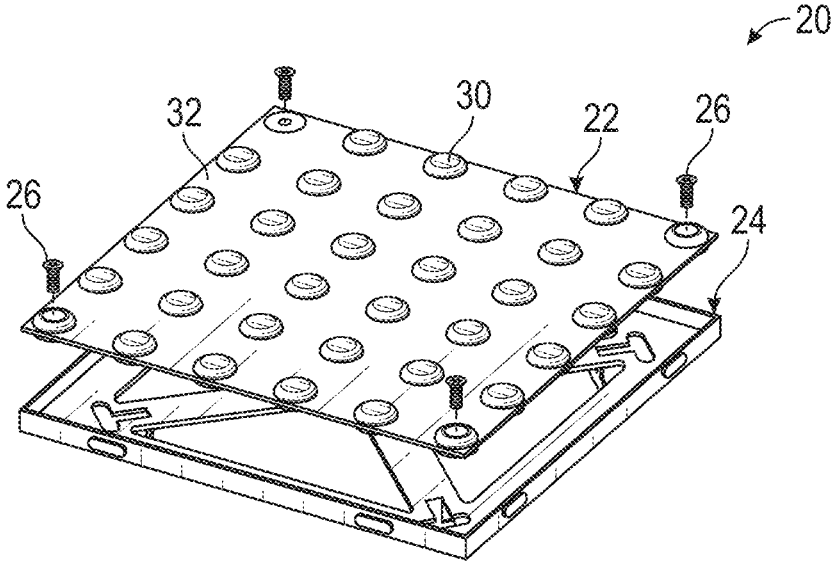
FIG. 1 is a top exploded perspective view of my new tactile tile assembly.
Figure 2:
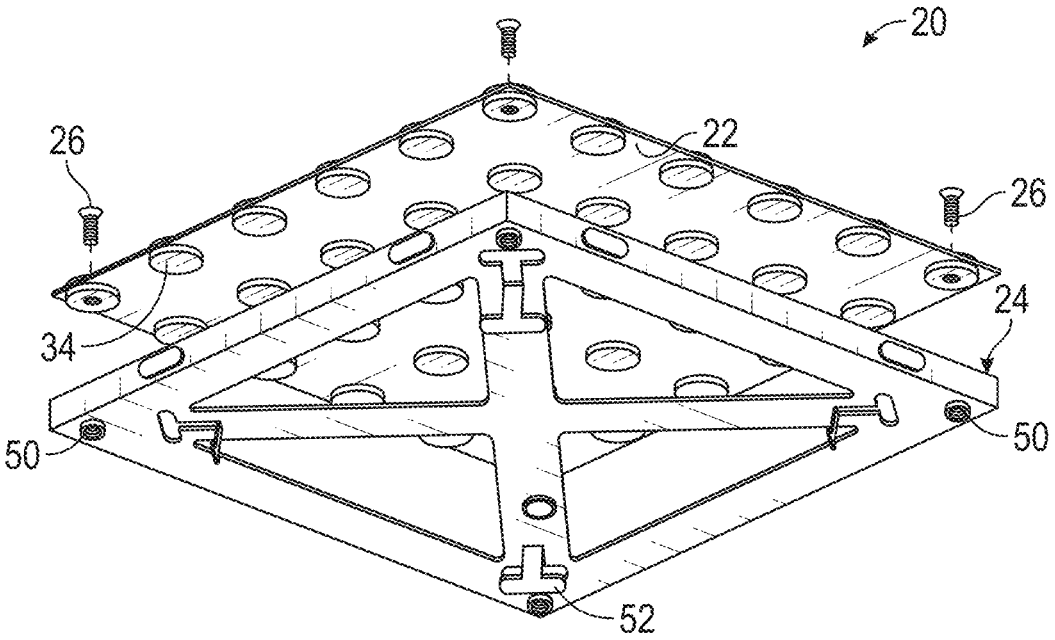
FIG. 2 is a bottom exploded perspective view of the tactile tile assembly of FIG. 1.
Figure 11:
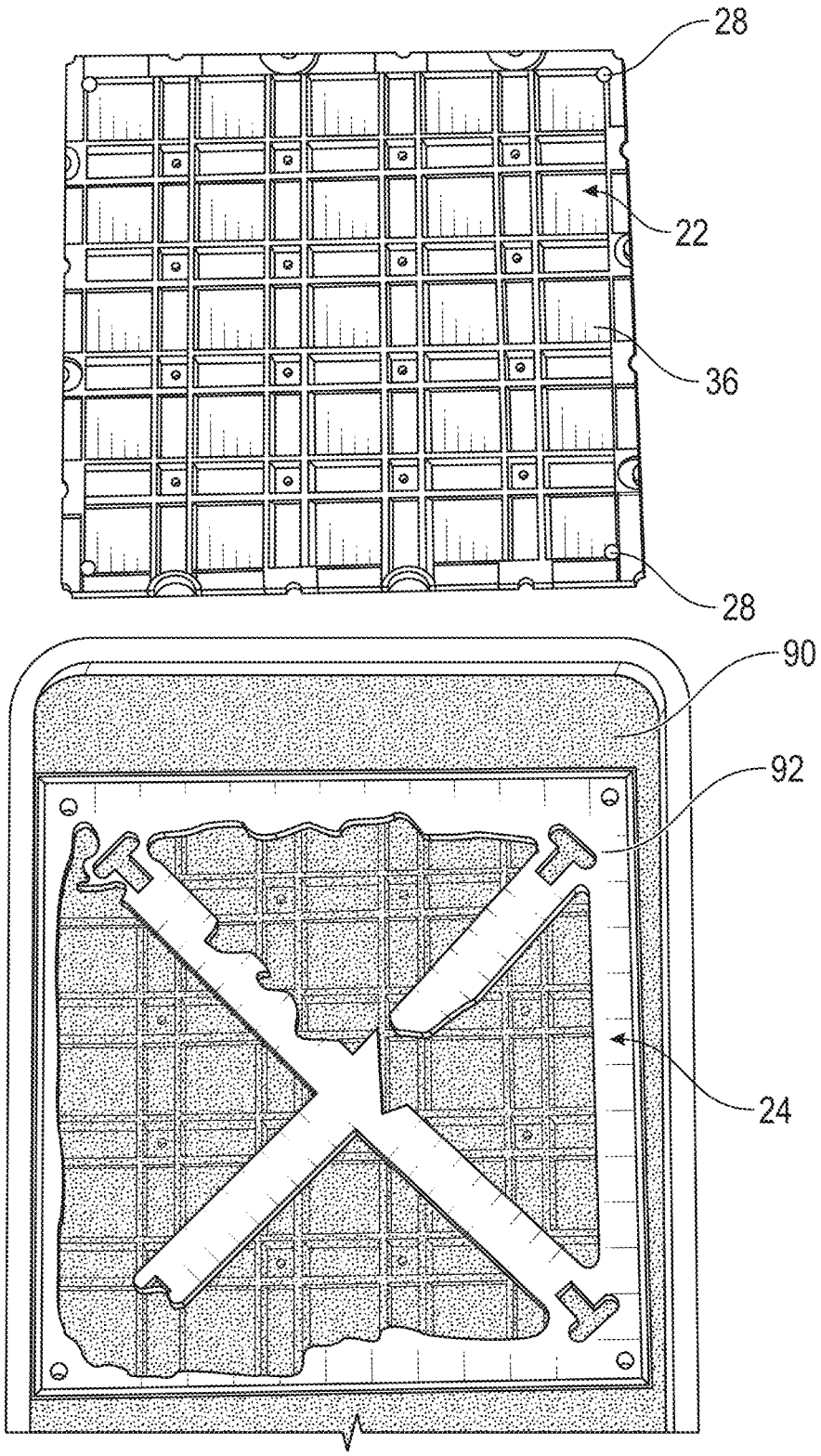
FIG. 11 is a top view of the base of FIG. 5 embedded in a paving material, and a bottom view of a tactile tile.

As shown in FIGS. 1 and 2, a tactile tile assembly 20 includes a tactile tile 22, a base 24 and fasteners 26 for attaching the tile 22 to the base 24. The top surface of the tile 22 has a pattern of protrusions 30 that project up from the field 32 of the top surface. The protrusions 30 at the corners and/or elsewhere on the tile 22 may have through holes 28, shown in FIG. 11, to allow the fasteners 26 to pass through. As shown in FIGS. 2 and 11, the bottom surface of the tile 22 may have projections 34 and/or ribs 36 to promote bonding between the tile 22 and the paving material that the tile is set into, as discussed below.

The tile 22, or portions of the tile 22, may be made of various suitable materials, including, but not limited to, steel, stainless steel, galvanized steel, hard plastics, impact resistant plastics and composites, fiber reinforced plastics, resins and the like, glass reinforced epoxy, and/or glass reinforced polyester. The tile material may also be provided in different colors and levels of brightness and/or reflectivity.

In the example shown in FIGS. 1 and 2, the fasteners 26 are threaded fasteners, such as cap screws, which engage into threads or threaded fittings 50 on or in the base 24. The threaded fittings 50 may be nuts pressed onto, or otherwise attached to the base 24. Embedment anchors 52 on the base 24 help to secure the tile assembly 20 into the paving material. In FIGS. 1 and 2 the embedment anchors 52 are shown as T-shaped tabs cut out in the base 24 and bent down to a vertical orientation. The embedment anchors may alternatively be provided as tabs having other shapes, and/or separate pieces in the form of tabs, rods, studs, etc., attached to the base. In some designs, the embedment anchors may be omitted. The number and positions of the embedment anchors may vary.

Figure 3:
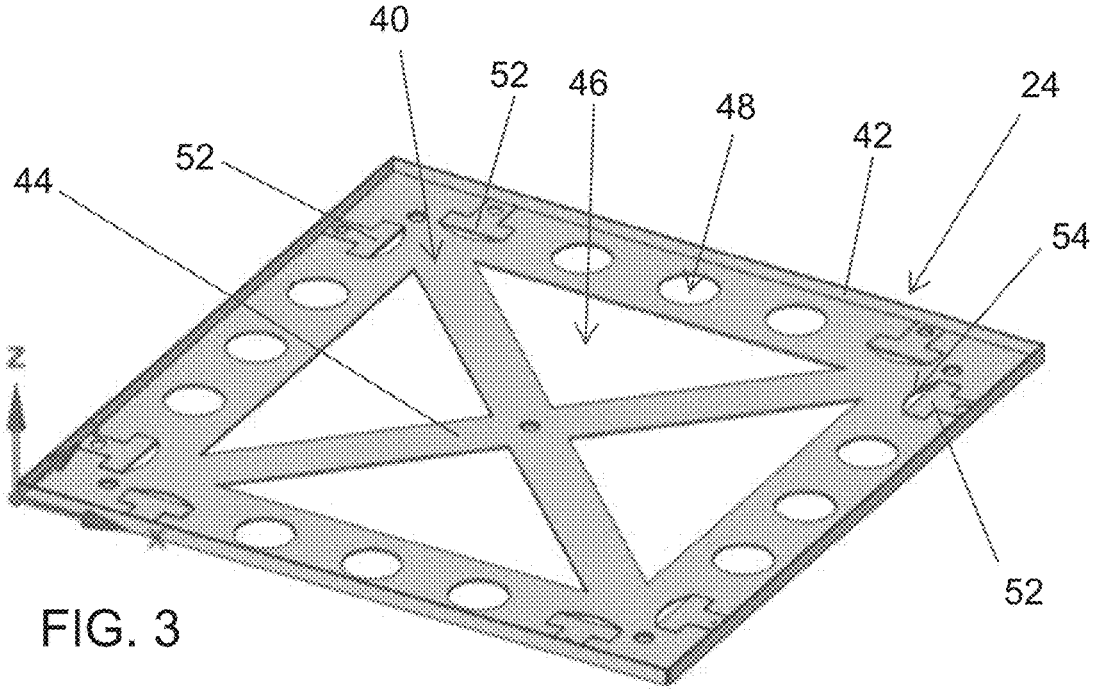
FIG. 3 is a top perspective view of an alternative base for use in a tactile tile assembly.

FIG. 3 shows an alternative base 25 similar to the base 24 in FIGS. 1 and 2. However, the base 25 has alternative embedment anchors 53, as well as holes 48 through the plate section 40 of the base 25.

Figure 12:
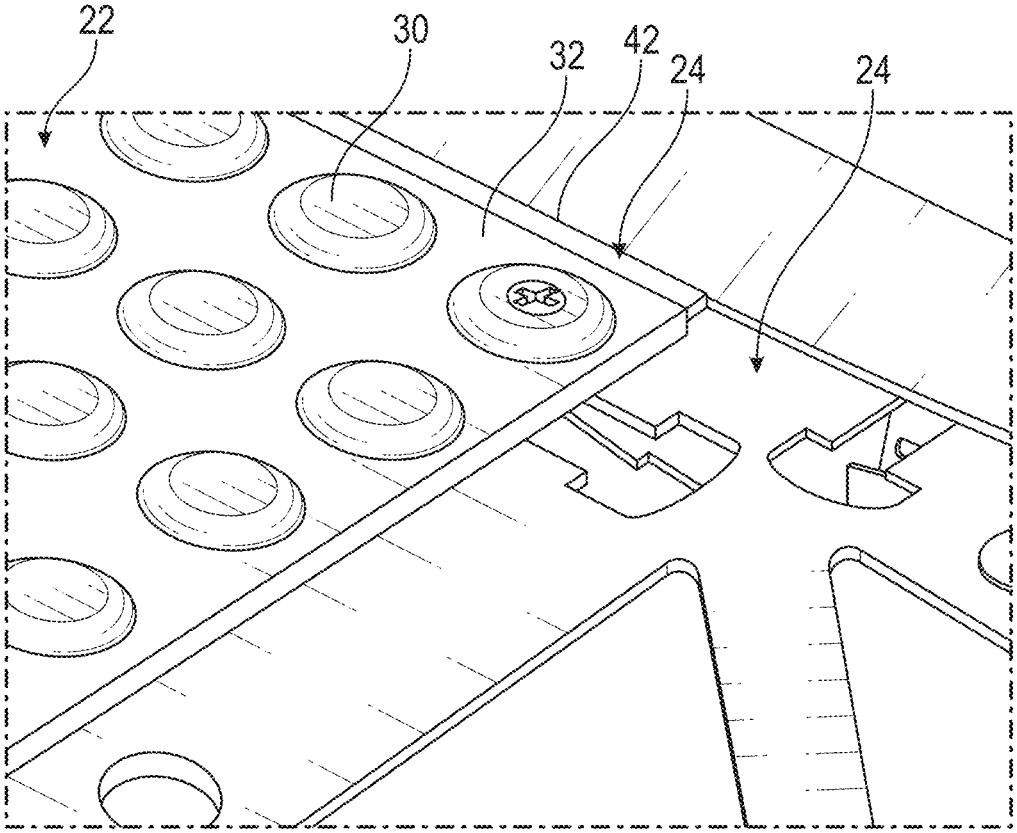
FIG. 12 is an enlarged top perspective detail view of a tactile tile attached to a base, with the base attached to an adjoining base.

Both bases 24 and 25 may have a rim 42 extending up from the plate section 40, and an X-section or shape forming triangular openings 46. The rim 42 forms a four-sided frame. If used, the holes 48 and openings 46 help to allow the tile 22 to bond to the paving material. The rim 42 is preferably perpendicular to the plate section 40. Referring momentarily to FIG. 12, with the tile 22 attached to the base 24 using the fasteners 26, the top surfaces of the protrusions 30 may be co-planer with, or at the same height as, the top edge of the rim 42. The field 32 of the tile 22 is correspondingly below the top edge of the rim 42, typically by about 5 mm.

Referring once again to FIGS. 1 and 2, four diagonal embedment anchors 52 are provided adjacent to the corners of the base 24, at the outer ends of the legs of the X-section 44. In the base 25 shown in FIGS. 3 and 4, two perpendicular embedment anchors 53 are provided at opposites sides of each corner of the base 25, for a total of eight embedment anchors 53. The outer end of each embedment anchor 53 may adjoin the rim 42. A tool opening 54 may be provided at the inner end of each embedment anchor. The base 25 also has a centrally located nut 50. The base 24 or 25 may be made via fabricating sheet metal, casting, molding, or 3D printing.

Figure 6:
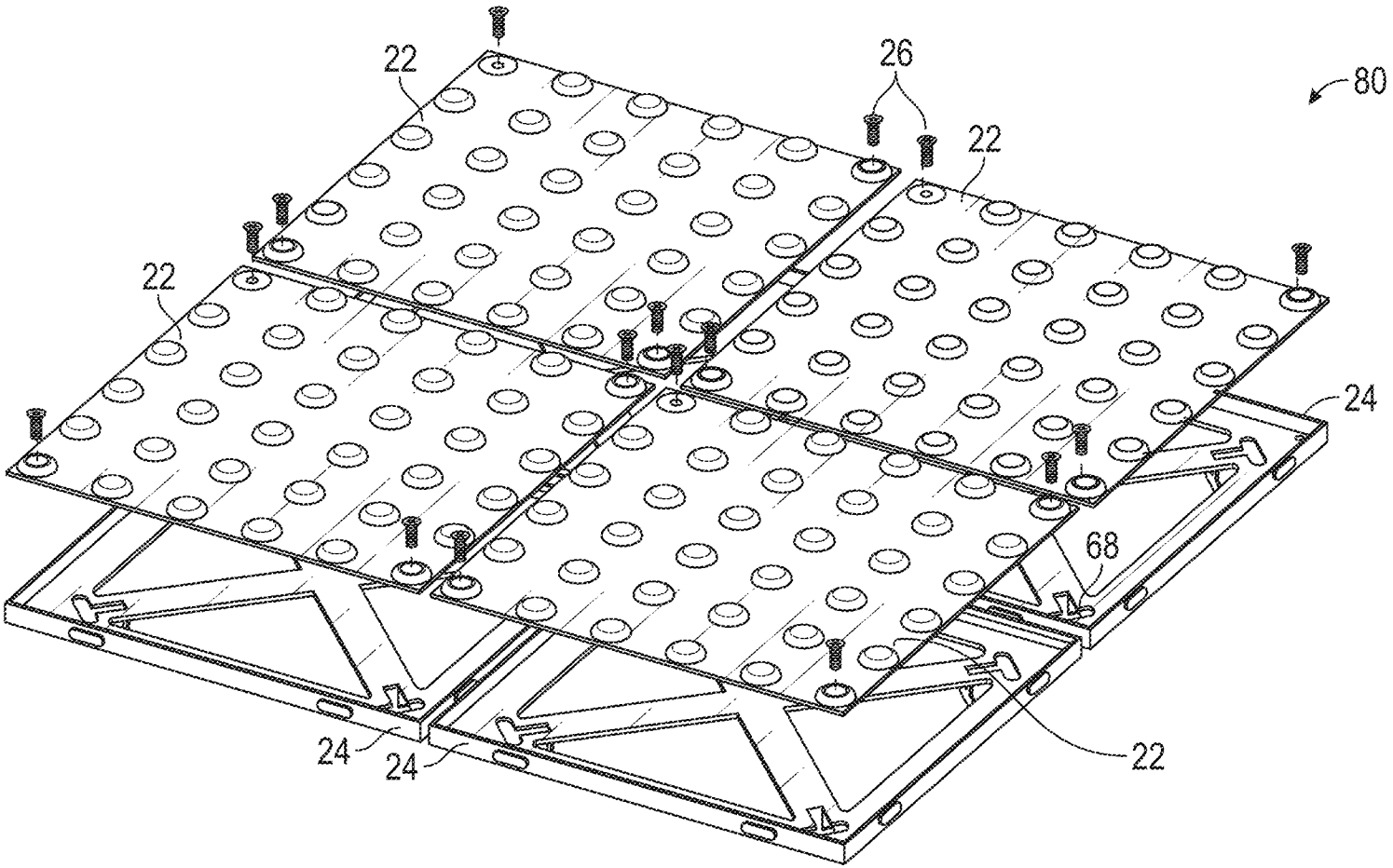
FIG. 6 is a top perspective view of four of the tactile tile assemblies of FIG. 1 attached to each other to provide a tactile tile assembly combination.
Figure 7:
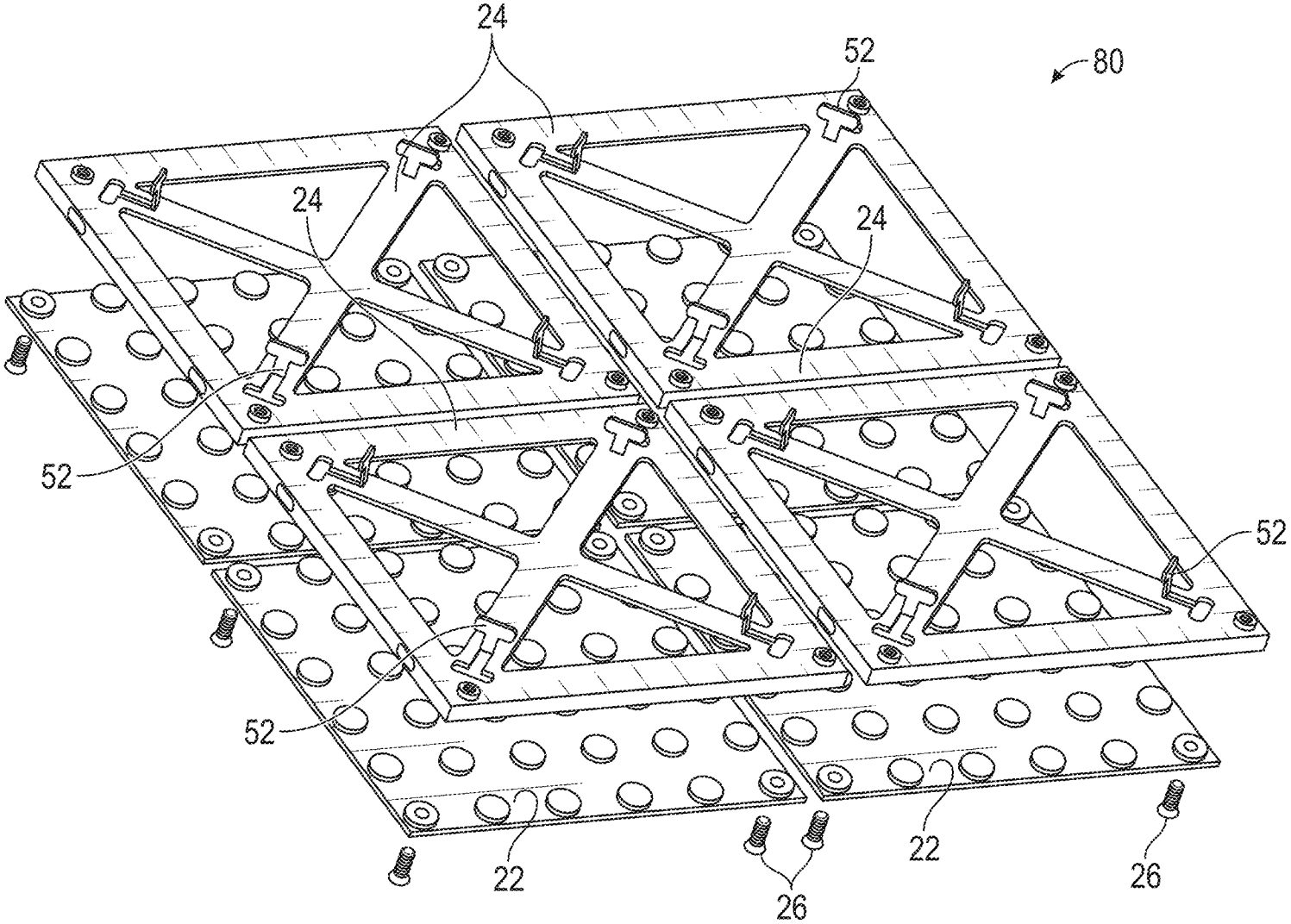
FIG. 7 is a bottom perspective view of the tactile tile assembly combination of FIG. 6.

Turning to FIGS. 6 and 7, two or more tile assemblies 20 are attached to each other to form a tile assembly combination 80. FIGS. 6 and 7 show four of the tile assemblies 20 in a two row and two column square configuration. In this example the base of each tile assembly is attached to the base of two other tile assemblies. Other configurations may of course also be used including elongated single row configurations, rectangular configurations, and larger square configurations. L and T shaped configurations may also be used.

Figure 5:
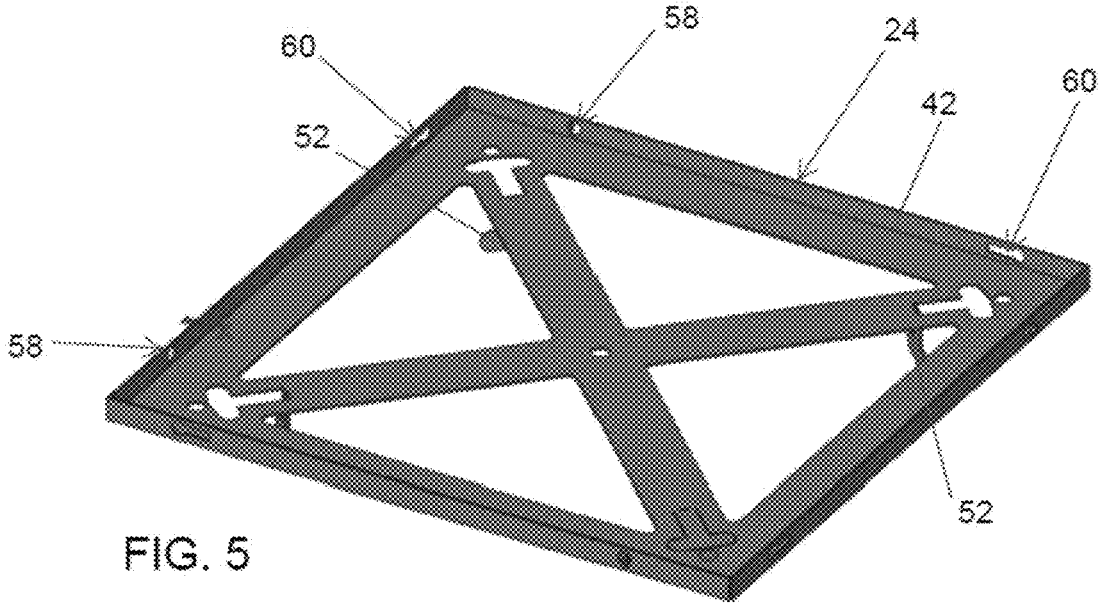
FIG. 5 is a top perspective view of the base of the tactile tile assembly of FIG. 1.
Figure 9:
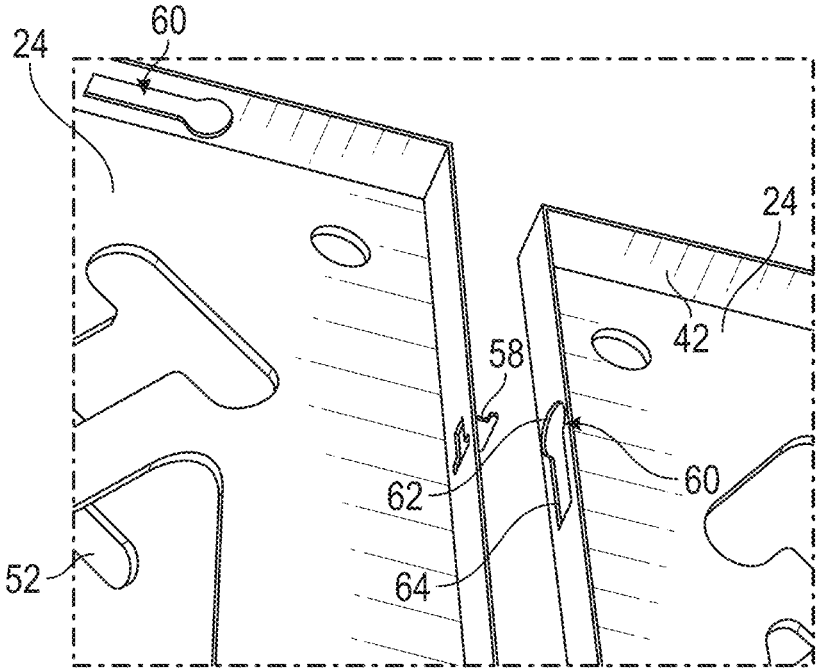
FIG. 9 is an enlarged bottom perspective detail view of features for attaching adjoining bases.

The base 24 and 25 may be provided with elements for attaching to the base of an adjoining or adjacent tile assembly. As shown in FIGS. 5 and 9, on each of the four sides of the rim 42, each base 24 may have an attachment tab 58 extending out from the rim 42, and an attachment opening 60 through the rim 42. Bases may be attached to each other by inserting the attachment tab 58 into the lead-in hole 62 of the attachment opening 60, and then moving the bases to bring the attachment tab 58 into the tab slot 64 of the attachment opening 60. The attachment tab 58 is then captive in the tab slot 64, attaching the bases, and adjoining tile assemblies, to each other.

Figure 8:
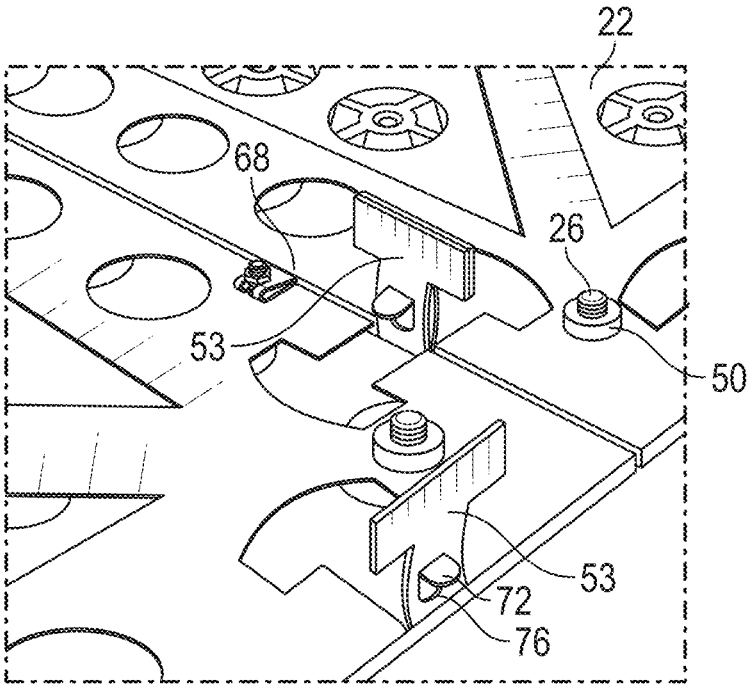
FIG. 8 is an enlarged bottom perspective detail view of the base of FIG. 3 attached to an adjoining base.
Figure 10:
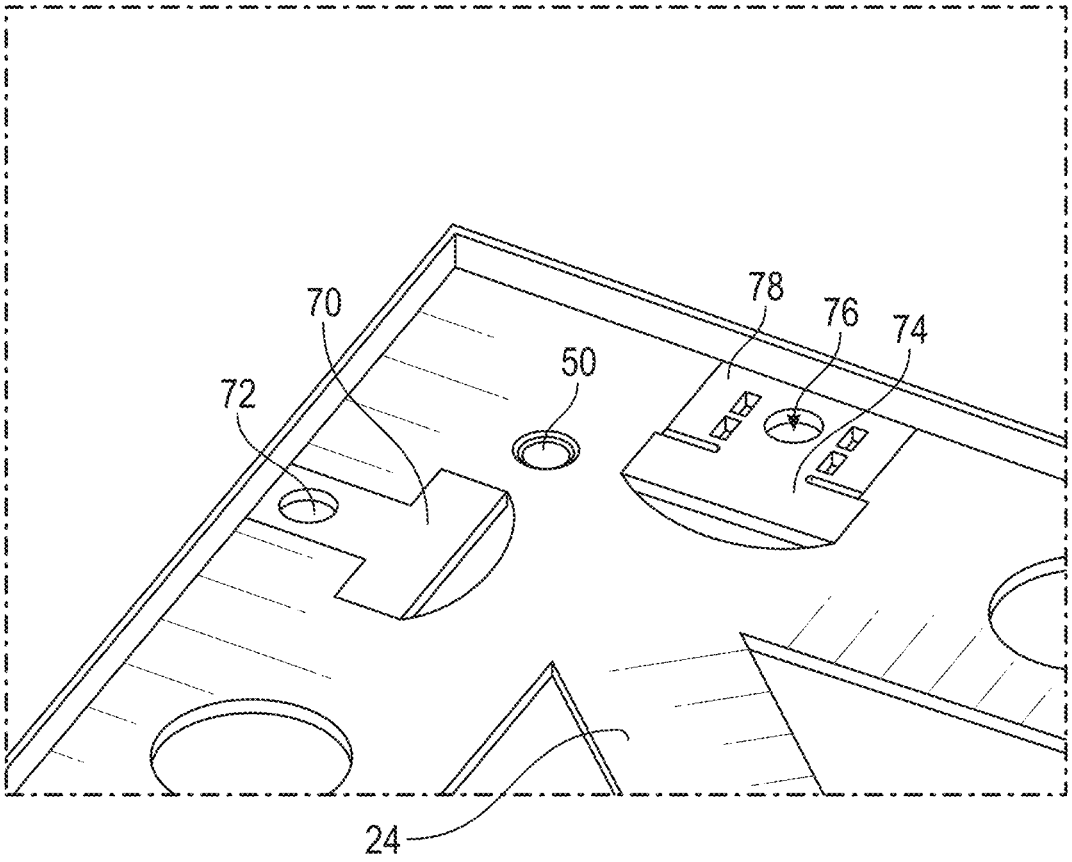
FIG. 10 is an enlarged bottom perspective detail view of attachment elements on embedment anchors of a base.

As shown in FIGS. 8 and 10, the embedment anchors 53 on the base 25 may include a positioning tab 72 and a positioning hole 76. As adjacent bases 25 are brought together, the positioning tab 72 moves into the positioning hole 76. This holds the bases in alignment with each other. A clip 68 may then be placed around or over adjacent embedment anchors 53 to attach tile assemblies together. Referring to FIG. 10, alternate embedment anchors 74 may include retainers 78 which may optionally be bent around an embedment anchor 53 of an adjacent tile assembly to attach tile assemblies together.

The devices selected to attach the tile assemblies advantageously hold the tile assemblies together in vertical alignment. Apart from the designs described above, the frames may optionally be attached to each other using conventional screw fasteners, rivets, clamps, interlocking hooks, etc.

In use, the tile assemblies 20 may be provided in a single uniform size and shape, for example with a square base 24 or 25 one foot long by one foot wide (30.5 cm by 30.5 cm). Since the tile assemblies may be attached to each other to form a desired configuration of any rectangular or square shape, unlike known tactile tiles, manufacturing and stocking multiple sizes of tile assemblies is not needed.

Figure 4:
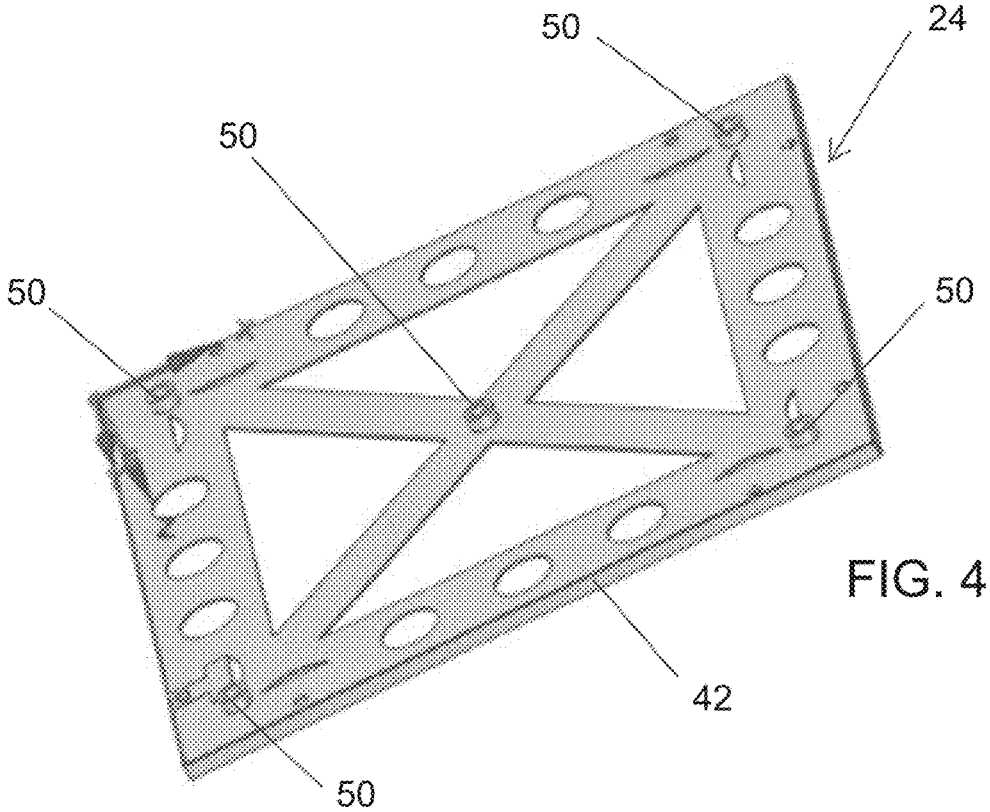
FIG. 4 is a bottom perspective view of the base of FIG. 3.

Tile assemblies 20 are attached together to provide a desired configuration of a tile assembly combination 80. This step may be performed without removing the tile 22 from the base 24 or 25. If the bases 24 or 25 are provided with in-plane embedment anchors 53 as shown in FIGS. 3 and 4, the embedment anchors 53 are bent into a perpendicular orientation. In some designs, this may be performed by hand without the need for any tools. In other designs a tool may be inserted into the tool opening 54, if used, to bend the embedment anchors 53. If the base has embedment anchors already projecting down, then no repositioning of the embedment anchors is needed.

The combination 80 is then moved over and placed down into the paving material. The devices attaching the tile assemblies 20 together hold the tile assemblies into vertical alignment. Referring to FIG. 11, the paving material 92 may be concrete, asphalt, or a similar material. The combination 80 is pressed into the paving material until the surface of the paving material 92 is generally substantially flush (within +/−0-6 mm) with the top edge of the rims 42. The tile may be tapped with a mallet to set the tile assembly at the desired depth into the paving material. As the plate section is largely open, the paving material can bond to the back side of the tile. The embedment anchors 52 or 53 project down into the paving material to better hold the tile assemblies in place. In FIG. 11, the ribs 36 create impressions 92 in the paving material. This also helps to bond the tile 22 to the paving material 92.

The potential for trapping air underneath the tiles 22 is reduced because air can escape from between adjacent tiles, in contrast to using a single large prior art tile having large continuous area. The rim 42 of each tile assembly helps to protect the tile 22 from damage. Generally, the tile 22 of each tile assembly 20 may be pre-installed onto the base 24 or 25 via the fasteners 26, during manufacture. Consequently, the installer need not perform this step. A damaged tile may be replaced by removing the fasteners 26, removing the damaged tile, and installing a new tile via the fasteners 26. The base 24 or 25 remains permanently in the paving material. Thus, tiles may be replaced without removing or replacing any paving material.

For some uses, a single tile assembly 20 may be used alone. In other uses, multiple tile assemblies 20 may be used, but without first attaching them together, for example to provide spaced apart or staggered tactile tile areas. In these applications, the tile assemblies need not include any attaching elements.

Each of the tile assemblies 20 in the tile assembly combination 80 may be identical. This simplifies providing and installing the combination. As used here, identical means the tile assemblies are the same in their essential characteristics necessary to perform, although they may vary in ways that do not affect their use, as described above. Alternatively, tile assemblies of varying sizes and shapes may be similarly used. For example, a tile assembly combination 80 may be formed by using both square and rectangular tile assemblies. The principals of the invention described above may also be used with tile assemblies having other geometric shapes, such as triangles, pentagons, hexagons, heptagons, octagons, etc.

Thus, novel tactile tile assemblies and methods have been shown and described. Various changes and substitutions may of course be made without departing from the spirit and scope of the invention. The invention, therefore, should not be limited, except by the following claims and their equivalents.

The invention claimed is:

1. A tile assembly, comprising:

a base including: a plate section, and a rim perpendicular to the plate section, the rim forming a four-sided frame; the four-sided frame forming an outer perimeter of the tile assembly; a plurality of embedment anchors on the base; a plurality of openings in the plate section; and a plurality of threaded fittings on or in the plate section;

a tile including: a plurality of projections on a top of tile, the tile having a size and shape adapted to fit within the four-sided frame, with a bottom of the tile contacting the plate section; and a plurality of fasteners extending through the tile, each fastener engaging one of the threaded fittings, to attach the tile to the base.

2. The tile assembly of claim 1 wherein the base is free of projections.

3. The tile assembly of claim 1 wherein the embedment anchors are provided in a plane of the plate section, and are bendable to a position perpendicular to the plate section for embedment into a pavement material.

4. The tile assembly of claim 1 further including at least one attachment tab on each side of the rim and at least attachment slot in each side of the rim, for attaching any side of the base to an adjoining base of a second tile assembly.

5. The tile assembly of claim 1 wherein one or more of the plurality of openings are non-round openings.

6. The tile assembly of claim 1 wherein the plate section has four corners with one of embedment anchors at each corner, and each embedment anchor projects downward from the plate section.

7. The tile assembly of claim 6 wherein the base has four embedment anchors and the plate section includes an X-section.

8. A tile assembly combination, comprising:

first and second tile assemblies, each tile assembly including:

a base including: a plate section, and a rim perpendicular to the plate section, the rim forming a frame; a plurality of embedment anchors; a plurality of openings in the plate section; and a plurality of threaded fittings on or in the plate section;

a tile including: a plurality of projections on a top of tile, the tile having a size and shape adapted to fit within the four-sided frame;

a plurality of fasteners extending through the tile, each fastener engaging one of the threaded fittings, to attach the tile to the base; and an attachment for attaching the bases of the first and second tile assemblies together.

9. The tile assembly combination of claim 8 wherein the attachment includes at least one tab on the rim of the base of the first tile assembly extending into an opening in the rim of the base of the second tile assembly.

10. The tile assembly combination of claim 8 wherein the attachment includes a clip attaching one of the embedment anchors of the first tile assembly to one of the embedment anchors of the second tile assembly.

11. The tile assembly combination of claim 8 wherein the attachment includes a retainer on one of the embedment anchors of the first tile assembly bendable around one of the embedment anchors of the second tile assembly.

12. The tile assembly combination of claim 8 wherein the embedment anchors of the first and second tile assemblies are formed by cutting through the plate section of the first and second tile assemblies, further including a tool opening in the plate section of the first and second tile assemblies, at each embedment anchor.

13. The tile assembly combination of claim 12 further including a positioning tab on alternate embedment anchors of the rim of the base of each of the first and second tile assemblies.

14. The tile assembly combination of claim 8 wherein in each tile assembly the frame is a four-sided frame forming an outer perimeter of the tile assembly.

15. A method of using tactile tile assemblies, comprising;

attaching a first base of a first tactile tile assembly to a second base of a second tactile tile assembly to provide a tactile tile assembly combination, the first tactile tile assembly including a first tactile tile secured onto the first base by a first plurality of threaded fasteners, the second tactile tile assembly including a second tactile tile secured onto the second base by a second plurality of threaded fasteners;

placing the tactile tile assembly combination into a paving material to provide a tactile tile surface; and allowing the paving material to cure.

16. The method of claim 15 wherein each base has a rim perpendicular to a plate section, and wherein the tactile tile assembly combination is placed into the paving material with a top of each rim substantially flush with a top surface of the paving material.

17. The method of claim 15 further including attaching the first base to the second base by inserting attachment tab on a rim of the first base into an attachment opening on a rim of the second base.

18. The method of claim 15 further including attaching the first base to the second base by securing a first embedment anchor on the first base to a second embedment anchor on the second base, and with each embedment anchor extending down into the paving material.

19. The method of claim 15 wherein the first base comprises a four-sided frame forming an outer perimeter of the first tactile tile assembly.

20. The method of claim 19 wherein the the first base and the second base each have non-round openings.

* * * * *